US007132782B2

(12) United States Patent
Kato et al.

(10) Patent No.: US 7,132,782 B2
(45) Date of Patent: Nov. 7, 2006

(54) SPARK PLUG AND METHOD OF PRODUCING SPARK PLUG

(75) Inventors: Tomoaki Kato, Nagoya (JP); Mamoru Musasa, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 212 days.

(21) Appl. No.: 09/893,488

(22) Filed: Jun. 29, 2001

(65) Prior Publication Data

US 2002/0017847 A1 Feb. 14, 2002

(30) Foreign Application Priority Data

Jun. 30, 2000 (JP) ..... 2000-199826

(51) Int. Cl.
*H01T 13/02* (2006.01)

(52) U.S. Cl. ..... 313/141; 313/143; 445/7

(58) Field of Classification Search ..... 313/143, 313/118, 140, 141; 123/169 R, 169 EL; 445/7

See application file for complete search history.

(56) References Cited

U.S. PATENT DOCUMENTS 6,045,424 A * 4/2000 Chang et al. ..... 313/118

6,215,234 B1 * 4/2001 Abe et al. ..... 313/141

FOREIGN PATENT DOCUMENTS

| | | |
|---|---|---|
| EP | 0 805 534 | 11/1997 |
| JP | 8-45643 | 2/1996 |
| JP | 11-154583 | 6/1999 |

OTHER PUBLICATIONS

European Search Report for EP 01 11 5813 dated Oct. 16, 2001.
Patent Abstracts of Japan, vol. 1995, No. 3, Apr. 28, 1995 and JP 06 338 376 dated Dec. 6, 1994.

* cited by examiner

*Primary Examiner*—Joseph Williams
(74) *Attorney, Agent, or Firm*—Sughrue Mion, PLLC

(57) ABSTRACT

A spark plug includes a center electrode, a ground electrode opposing the center electrode in such a manner as to define a spark discharge gap between the center electrode and the ground electrode, and an igniter fixed to at least one of the center electrode and the ground electrode in such a manner as to face the spark discharge gap. The igniter is composed of a metallic material whose principal component is one of a platinum and an iridium. One type of the metallic material of the igniter contains an oxygen content of not more than 120 ppm. Another type of the metallic material of the igniter has a crystal grain of not less than 50 μm in mean diameter, and contains the oxygen content of not more than 300 ppm.

22 Claims, 4 Drawing Sheets

SPARK PLUG AND METHOD OF PRODUCING SPARK PLUG

BACKGROUND OF THE INVENTION

The present invention relates to a spark plug and a method of producing the spark plug.

Conventionally, the spark plug has an electrode having a chip at an end of the electrode. The chip is so welded as to form an igniter. It is Pt (platinum) that is used for a principal component of the chip of the electrode, to thereby improve spark durability. Recently, in order to further improve the spark durability, as the case maybe, Ir (iridium) replaces Pt for the main component of the chip of the electrode of the spark plug.

The spark plug having the above one of Pt and Ir as the material of the igniter is used for a gas engine. For example, the gas engine is the one referred to as a cogeneration gas engine which utilizes both emission heat and combustion heat. In this case, during a combustion process of a mixture in a combustion chamber of the internal combustion engine, the igniter of the spark plug is likely to be subjected to a cooling-and-heating cycle. More specifically, the cooling-and-heating cycle causes a quick cooling during a mixture intake process, and a quick heating during a mixture combustion process. Such cooling-and-heating cycle is more likely to occur to a lean burn engine which is designed to reduce NOx and the like contained in emission gas.

The cooling-and-heating cycles (heavy duty) repeatedly applied to the igniter causes the igniter to have its metal surface peeled. The thus peeled metal piece is melted by a discharge, to thereby cause a sweat (a phenomenon in which the melted metal piece jumps, and then re-adheres). The peel and the sweat may cause the metal pieces to be accumulated across a spark discharge gap, to thereby cause a bridging. This is likely to cause an ignition failure attributable to a short gap. Especially, many of the spark plugs for the gas engine are likely to cause the bridging and the like since the gap of the gas engine is so small as to obtain a lower discharge voltage.

SUMMARY OF THE INVENTION

It is therefore an object of the present invention to provide a spark plug which is unlikely to cause a peel, a sweat, and the like to an igniter. More specifically, the spark plug under the present invention is the one that is unlikely to cause a short gap attributable to the bridging even when the spark plug is used for a gas engine and the like.

It is another object of the present invention to provide a method of producing the spark plug having the above mentioned features.

According to a first aspect of the present invention, there is provided a spark plug comprising: a center electrode; a ground electrode opposing the center electrode in such a manner as to define a spark discharge gap between the center electrode and the ground electrode; and an igniter fixed to at least one of the center electrode and the ground electrode in such a manner as to face the spark discharge gap. The igniter is composed of a metallic material whose principal component is one of a platinum and an iridium, and the metallic material of the igniter comprises an oxygen content of not more than 120 ppm.

According to a second aspect of the present invention, there is provided a spark plug comprising: a center electrode; a ground electrode opposing the center electrode in such a manner as to define a spark discharge gap between the center electrode and the ground electrode; and an igniter fixed to at least one of the center electrode and the ground electrode in such a manner as to face the spark discharge gap. The igniter is composed of a metallic material whose principal component is one of a platinum and an iridium. The metallic material of the igniter comprises a crystal grain of not less than 50 μm in mean diameter, and comprises an oxygen content of not more than 300 ppm.

According to a third aspect of the present invention, there is provided a method of producing a spark plug. The method comprises the following sequential steps of: carrying out a heat treatment on a metallic material chip at a heat treatment temperature of not less than 800° C. and not more than a melting point of the metallic material chip, so that a crystal grain of the metallic material chip is not less than 50 μm in mean diameter with the metallic material chip comprising an oxygen content of not more than 300 ppm, the metallic material chip comprising a principal component of one of a platinum and an iridium; welding the metallic material chip to at least one of a center electrode and a ground electrode; and forming an igniter based on the metallic material chip.

According to a fourth aspect of the present invention, there is provided a method of producing a spark plug, which is substantially the same as the method according to the third aspect of the present invention, except that the heat treatment is carried out after the welding.

BRIEF DESCRIPTION OF THE DRAWINGS

FIG. 1 is a spark plug 100, according to a first preferred embodiment of the present invention concerning a constitution of the spark plug 100, in which;

FIG. 1(*a*) is a front view of the spark plug 100, and

FIG. 1(*b*) is similar to FIG. 1(*a*) but showing a half section (cutaway) of the spark plug 100 in FIG. 1(*a*);

FIG. 3 shows three schematic diagrams of a heat treatment, each diagram showing one of a chip and a chip material used for an igniter, according to a second preferred embodiment of the present invention concerning a method of producing the spark plug 100, in which;

FIG. 3(*a*) shows a plate material 300,

FIG. 3(*b*) shows a rod martial 210, and

FIG. 3(*c*) shows first and second chips 150; and

FIG. 4 shows two schematic diagrams of the heat treatment, each diagram showing that the chip (igniter) is joined to an electrode so as to form the igniter, in which;

FIG. 4(*a*) shows a second igniter 32 joined (welded) to a ground electrode 4, and FIG. 4(*b*) shows a first igniter 31 joined (welded) to a central electrode 3.

DETAILED DESCRIPTION OF THE PREFERRED EMBODIMENT

Figure 1A:
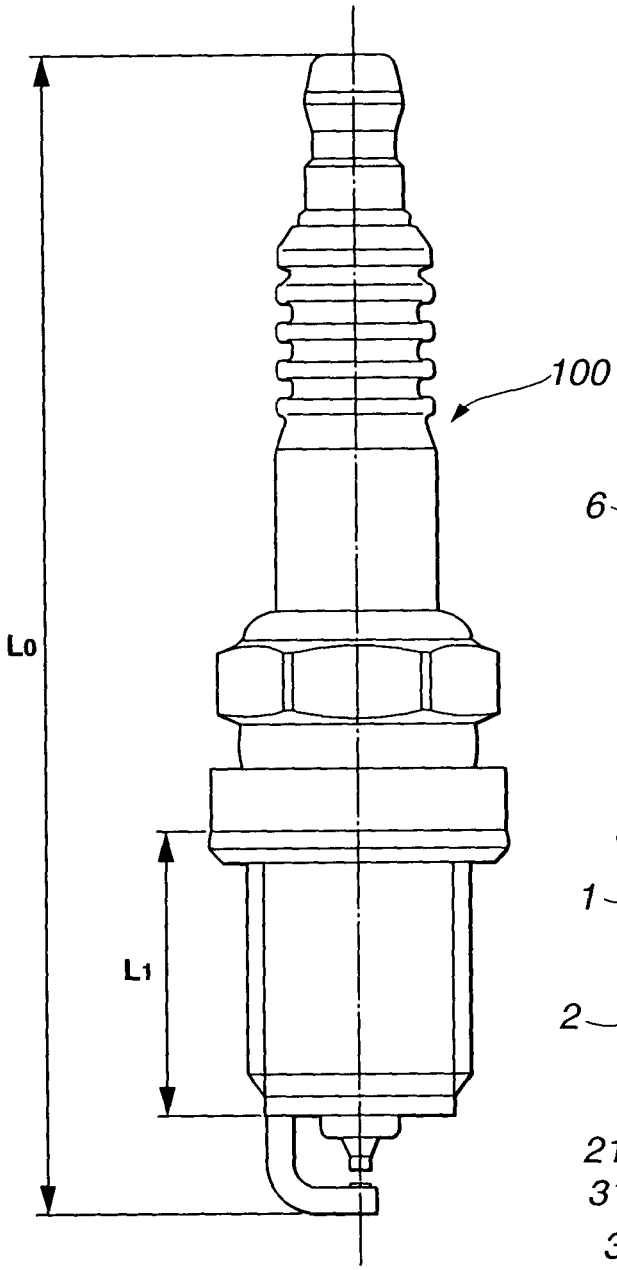

In the following first preferred embodiment (concerning a constitution of a spark plug) and second preferred embodiment (concerning a method of producing the spark plug), an igniter is formed by welding a chip to an electrode. The chip is composed of a metal. The igniter under the present invention is a portion (of the welded chip) that is not influenced by a composition change. More specifically, the igniter under the present invention is distinguished from the other portion (of the welded chip) that is alloyed, through the welding, with a material of a ground electrode or a center electrode.

Moreover, the term "principal" or those related thereto with respect to a component is defined as having the highest percentage content of a total mass.

Reducing an oxygen content of a metal of the igniter works to inhibit a peel and a sweat from occurring, for the following presumed causes:

When the metal composing the igniter is solved, the oxygen is usually contained in the metal in such a manner that the oxygen is solved into the metal. After the metal is solidified, the oxygen is considered to exist in the metal in the form of a solid solution. When the spark plug is mounted to an internal combustion engine and then is used, the solid solution oxygen contained in the metal of the igniter is likely to be deposited at a crystal grain boundary if the solid solution oxygen is exposed to a high temperature atmosphere in the internal combustion engine. Then, the solid solution oxygen is likely to react to a component in the atmosphere. Included in the component is hydrogen and the like which is diffused from a surface of the metal by way of the crystal grain boundary. Thereby, the solid solution oxygen reacting to the component is likely to embrittle a crystal grain boundary layer. The above likelihood of the solid solution oxygen is considered to be encouraged in an atmosphere where a comparatively large amount of hydrogen exist (especially, in a gas engine). Moreover, when the ambient temperature is so high as to easily cause a crystal grain boundary movement (which is caused according to a crystal grain growth), a crystal grain component atom is rearranged accordingly. Thereby, the dissolved oxygen is more likely to be ejected from a metal phase, and then is more likely to be deposited to the crystal grain boundary, to thereby encourage the likelihood of the solid solution oxygen as stated above. Moreover, within the crystal grain boundary, the metal causes a volume expansion and a gas deposit. When a surface of the igniter is attacked by a strong spark under this condition, the crystal grain boundary is destroyed and the crystal grain falls, to thereby cause the peel and the sweat easily.

When the oxygen content is low in the metal, the oxygen deposited on the crystal grain boundary is low in quantity. With this, destruction (caused by the spark attack) of the crystal grain boundary is inhibited, to thereby inhibit the crystal grain from falling. Therefore, the peel and the sweat of the igniter are prevented or inhibited. Furthermore, with the crystal grain increased in mean diameter, more powerful spark attack is required to fall a single crystal grain. Therefore, the crystal grain is less likely to cause the falling which is attributable to the destruction of the crystal grain boundary. Therefore, with the mean crystal grain diameter of not less than 50 μm (large), an upper limit of the oxygen content can be increased to 300 ppm. When the metal contains a high oxygen content, the metal organization is unlikely to cause a recrystallization, and the mean crystal grain diameter is likely to be small, to thereby cause the crystal grain to fall more likely. However, if the oxygen content is limited to not more than 300 ppm, the metal is likely to be recrystallized progressively, to thereby facilitate obtaining the mean crystal grain diameter of not less than 50 μm. The not less than 50 μm is the dimension that is effective for preventing the igniter from causing the peel and the sweat.

Figure 1B:
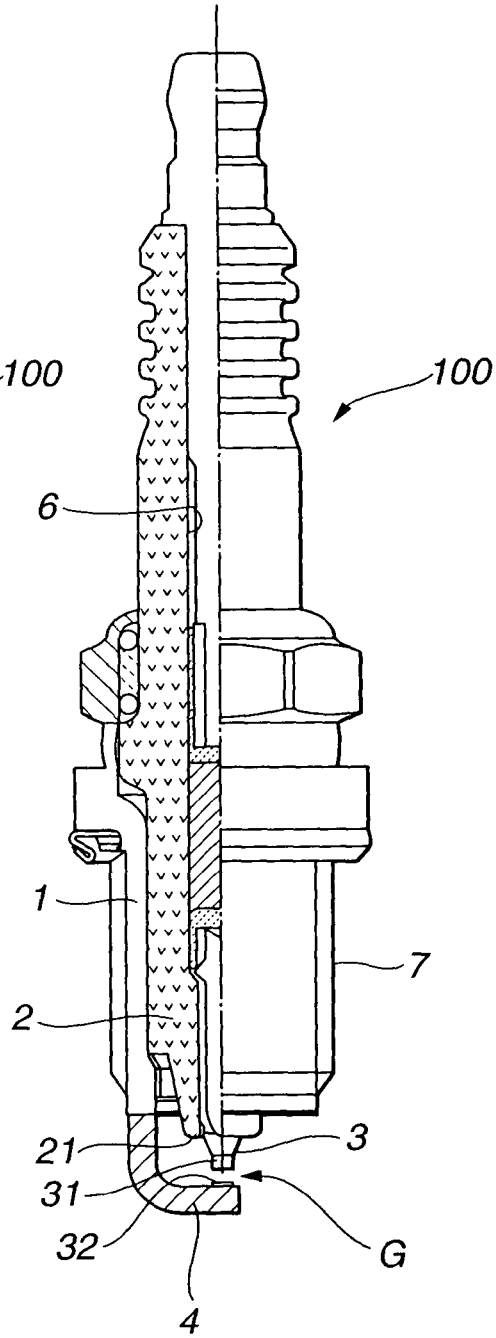

As is seen in FIG. 1(*a*) and FIG. 1(*b*), there is provided a spark plug 100, according to the first preferred embodiment of the present invention. The spark plug 100 is used for various applications such as ignition of a cogeneration gas engine which utilizes both emission heat and combustion heat. As is seen in FIG. 1(*b*), there is provided a metallic shell 1, an insulator 2, a center electrode 3, a ground electrode 4 and the like. The metallic shell 1 is cylindrical in shape. The insulator 2 is inserted in the metallic shell 1, and has a insulator tip end 21 which is projecting from the spark plug 100. The center electrode 3 is disposed inside the insulator 2 and has a noble metallic first igniter 31 (hereinafter referred to as "first igniter 31") which is so formed as to project at a tip end of the center electrode 3. The ground electrode 4 has a first end which is joined with the metallic shell 1 by welding and the like, and a second end which is bent sideward. The thus bent second end of the ground electrode 4 has a first surface {upper in FIG. 1(*b*)} which opposes the tip end of the center electrode 3. Moreover, there is formed a second igniter 32 on the first surface of the ground electrode 4. The second igniter 32 opposes the first igniter 31. There is defined a spark discharge gap G between the first igniter 31 and the second igniter 32.

The spark discharge gap G of the spark plug 100 is in a range from 0.2 mm to 0.6 mm. The spark plug 100 has a total length LO in a range from 60 mm to 100 mm (for example, 74.5 mm). As is seen in FIG. 1(*a*), there is defined a screw reach L1 which has a length in a range from 12.5 mm to 26.5 mm (for example, 19 mm). Nominal screws used for a mounting screw 7 include M10, M12, M14 and M18 (for example, M14), each designating a metric thread followed by an outside diameter (nominal) in millimeters.

The insulator 2 is constituted of a ceramic sintered body which is made of material such as alumina, aluminum nitride and the like. As is seen in FIG. 1(*b*), there is defined an opening 6 in the insulator 2. The opening 6 is used for mating the center electrode 3 along a longitudinal axis of the insulator 2. The metallic shell 1 is made of metal such as low carbon steel and the like, and is substantially cylindrical in shape. The metallic shell 1 is a housing of the spark plug 100, and has an external surface. The mounting screw 7 is disposed on the external surface of the metallic shell 1, and is used for mounting the spark plug 100 to an engine block (not shown).

The tip end of each of the center electrode 3 and the ground electrode 4 is formed with a surface layer. The surface layer is made of a heat resisting alloy. The heat resisting alloy is the one having a principal component of one of Ni (nickel) and Fe (ferrum or iron). Categorized in the heat resisting alloy having the principal component of Ni is, for example, INCONEL 600, INCONEL 601 and the like (INCONEL: a trade name for a nickel-base alloy containing chromium, molybdenum, iron, and smaller amounts of other elements—by Dictionary of Science and Technology, Academic Press).

Figure 2:
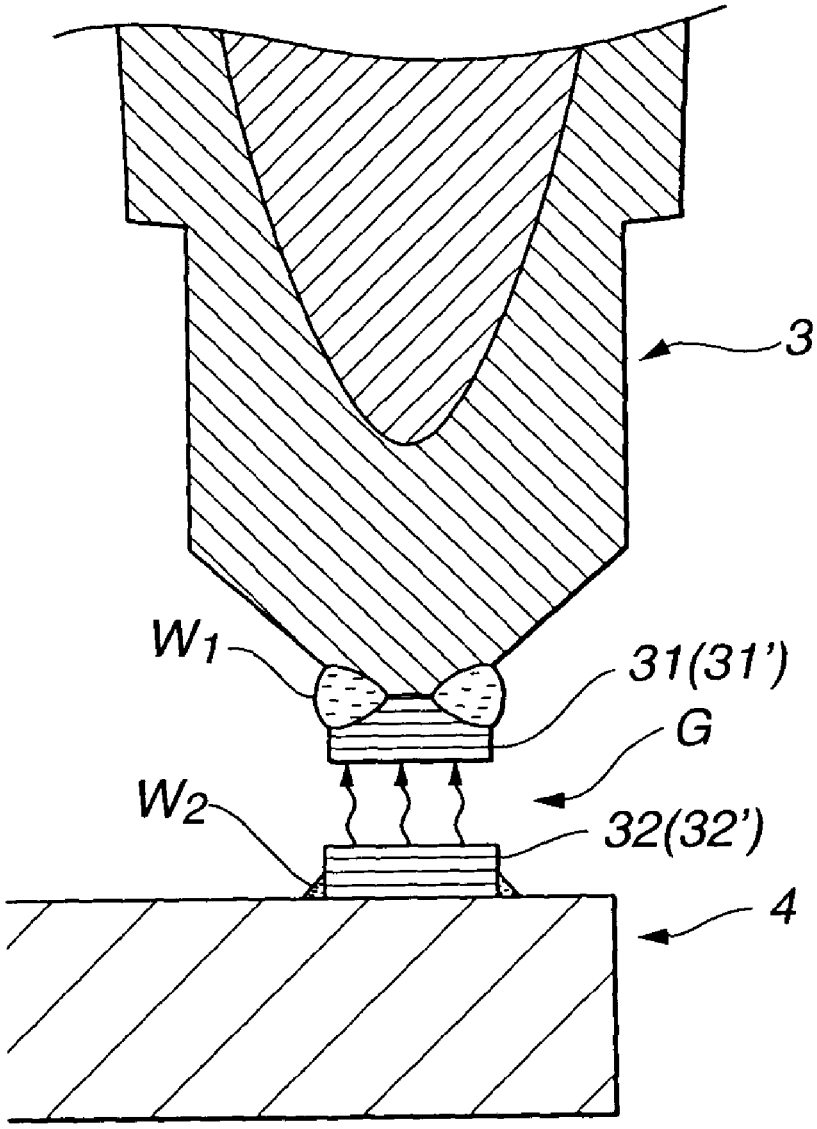
FIG. 2 shows enlarged essential portions of the spark plug 100.

As is seen in FIG. 2, each of the first igniter 31 and the second igniter 32 opposing the first igniter 31 is made of metal which is principally composed of one of Pt (platinum) and Ir (iridium) {the metal composed of at least one of Pt and Ir is hereinafter referred to as "noble metallic material"}. Each of the first igniter 31 and the second igniter 32 has an oxygen content of not more than 120 ppm. Alternatively, each of the first igniter 31 and the second igniter 32 has the oxygen content of not more than 300 ppm (preferably, however, not more than 120 ppm), with a mean crystal grain diameter of not less than 50 μm. The above mean crystal grain diameter does not specifically define an upper limit. In other words, the crystal grain is allowed to be so large as to constitute a coarse crystal structure in which only one or several crystal grains constitute the entire metal of the igniter 31 or the igniter 32 (In this case, the mean crystal grain diameter is as large as the igniter 31 or the igniter 32 in dimension.). Just for information, each of the first igniter 31 and the second igniter 32 having the oxygen content of more than 300 ppm makes it difficult to prevent the peel and the sweat from occurring even if the mean crystal grain diameter is not less than 50 μm.

When the spark plug 100 is mounted to the cogeneration gas engine and then is used, the first igniter 31 and the second igniter 32 may peel or may cause sweat, to thereby form a bridging at the spark discharge gap G. With the above oxygen content and the mean crystal grain diameter, the bridging can be effectively inhibited.

One of the first igniter 31 (on the center electrode 3) and the second igniter 32 (on the ground electrode 4) can be omitted from the constitution of the spark plug 100. In this case, the spark discharge gap G is formed in one of the following two portions: 1. Between the first igniter 31, and the first surface of the ground electrode 4 (second igniter 32 not provided). 2. Between the second igniter 32, and the tip end of the center electrode 3 (first igniter 31 not provided). It is generally more effective to provide the igniter on the ground electrode 4 (namely, the second igniter 32) which is likely to cause a temperature increase.

Stated below are four kinds of noble metallic materials, each of the four composing the first igniter 31 and the second igniter 32:

1. Pt—Ni alloy

Pt is the principal component, while Ni can be contained by 2% to 40% of a total mass. The thus obtained Pt—Ni alloy has an advantage of improved peel proof of a weldment. When Ni percentage content is less than 2% of a total mass, the above advantageous effect is not brought about satisfactorily. On the other hand, when the Ni percentage content is more than 40% of the total mass, melting point of the Pt—Ni alloy is lowered, to thereby cause spark durability of the igniter to become unsatisfactory. During spark discharge, the Pt—Ni alloy is likely to cause grains to fall, and is likely to cause melted splashed grains to re-adhere. Thereby, the Pt—Ni alloy is most likely to cause the bridging and the like. The presumable cause of the above likelihood of the Pt—Ni alloy is that the Pt—Ni alloy is more likely to be magnetized than other noble metallic materials. In either case, the present invention can effectively prevent or inhibit the bridging and the like from occurring.

Pt—Ir alloy

One of Pt and Ir is the principal component. Ir can be contained by 2% to 98% of the total mass. The thus obtained Pt—Ir alloy has an advantage of improved heat resistance of the igniter, thus resulting in a remarkably improved spark durability. These improvements are attributable to the added Ir. When the Ir percentage content is less than 2% of the total mass, however, the above two advantageous effects are not brought about satisfactorily. On the other hand, when the Ir percentage content is more than 98% of the total mass, oxidation-and-volatilization of Ir at high temperature is likely to advance, to thereby cause the oxidation-and-volatilization durability of the igniter to become unsatisfactory.

3. Pt—Ir—Ni alloy

Pt is the principal component. Ir can be contained by 2% to 40% of the total mass, while Ni can be contained by 2% to 40% of the total mass. The thus obtained Pt—Ir—Ni alloy has an advantage of good spark durability, and another advantage of improved peel proof of the weldment. When the Ir percentage content is less than 2% of the total mass, however, the spark durability is unsatisfactory, while when the Ir percentage content is more than 40% of the total mass, the peel proof at the weldment is unsatisfactory. On the other hand, when the Ni percentage content is less than 2% of the total mass, the peel proof of the weldment is unsatisfactory. Contrary to this, when the Ni percentage content is more than 40% of the total mass, the spark durability is unsatisfactory, and workability (or machinability, formability) of the alloy is worsened, to thereby lower production efficiency as well as yield (unavoidable).

4. Ir—Ni alloy

One of Ir and Ni is the principal component. Ni can be contained by 2% to 70% of the total mass. The thus obtained Ir—Ni alloy with the principal component of Ir has an advantage of improved heat resistance of the igniter, thus resulting in a remarkably improved spark durability, which is attributable to the principal component Ir. When the Ni percentage content is less than 2% of the total mass, however, the oxidation-and-volatilization of Ir at high temperature is likely to advance, to thereby cause the oxidation-and-volatilization durability of the igniter to become unsatisfactory. Contrary to this, when the Ni percentage content is more than 70% of the total mass, melting point of the Ir—Ni alloy is lowered, to thereby cause the spark durability to become unsatisfactory.

Stated below is the method of producing the spark plug 100, according to the second preferred embodiment of the present invention.

As is seen in FIG. 2, at the tip end (surface) of the center electrode 3, there is overlapped a first chip 31' which constitutes the first igniter 31 (see FIG. 1). The first chip 31' is shaped into a circular plate, and is composed of an alloy. Moreover, around the entire circumference of a joining surface of the first chip 31', there is formed a first laser weldment W1 formed by means of a laser welding. The, the thus formed laser weldment W1 is solidified, to thereby form the first igniter 31. On the other hand, there is provided the second igniter 32 opposed correspondingly to the first igniter 31. A second chip 32' is positioned on the ground electrode 4 in a position opposing the first igniter 31. Around the entire circumference of a joining surface of the second chip 32', there is formed a second laser weldment W2 formed through the laser welding. The thus formed laser weldment W2 is solidified, to thereby form the second igniter 32. When each of the first chip 31' and the second chip 32' is an alloy containing Ir, the melting point is high. Therefore, the laser welding is preferred. Contrary to this, when each of the first chip 31' and the second chip 32' is an alloy containing Pt, the melting point is lower than the Ir-containing alloy. Therefore, a resistance welding is applicable.

Each of the first chip 31' and the second chip 32' (hereinafter referred to as "first and second chips 150" in combination, if necessary) is formed in the following steps:

1. Each alloy component is so blended and solved as to obtain a solution material having a predetermined composition. The thus obtained solution material is subjected to one of the following steps 2-1 and 2-2:

2-1.

I. The solution material of the alloy is subjected to a cold rolling (at an ordinary temperature), to thereby form a plate material.

II. The thus obtained plate material is subjected to a hot punching (for example, at not less than 700° C.; or a warm punching), to thereby form a punched chip having a predetermined configuration.

2-2.

I. The solution material of the alloy is subjected to one of a hot rolling (for example, at not less than 700° C.; or a warm rolling), a hot forging (for example, at not less than 700° C.; or a warm forging) and a hot wire drawing (for example, at not less than 700° C.; or a warm wire drawing), to thereby form one of a linear material and a rod material.

II. The thus obtained one of the linear material and the rod material is cut in a longitudinal direction into pieces each having a predetermined length. The cutting includes an electric discharge cutting.

The hot machining (punching, rolling, forging, wire drawing, and the like) is effective especially for machining the Ir-containing alloy whose workability (or machinability, formability) is of difficulty.

Moreover, the solution material of the alloy can be formed substantially into a sphere through an atomizing method.

Figure 3A:
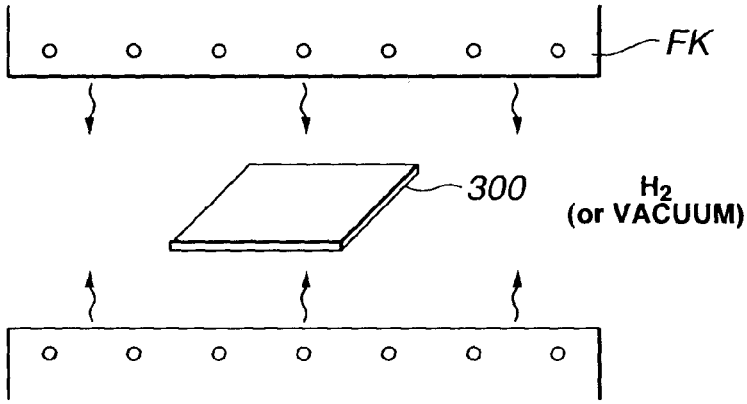
Figure 3B:
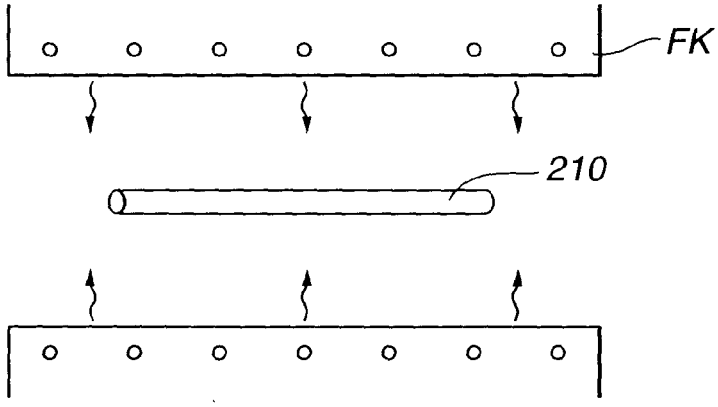
Figure 3C:
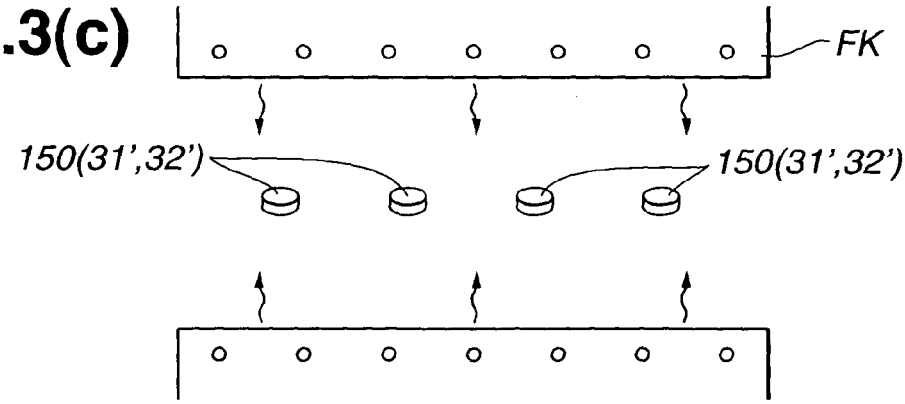

As is seen in FIG. 3(*a*), FIG. 3(*b*), and FIG. 3(*c*), there are provided, respectively, a plate material 300, a rod material 210, and the first and second chips 150. The rod material 210 and the plate material 300 and the like are materials which are used for producing the first and second chips 150. Prior to the welding, each of the plate material 300 and the rod material 210 is subjected to a heat treatment at not less than 800° C. (and not more than a "melting point" of the metallic material: In the case of the alloy, the "melting point" is replaced with a "liquidus line temperature.") in one of a reduced pressure atmosphere and a hydrogen atmosphere. After the heat testament, each of the first and second chips 150, the plate material 300, and the rod material 210 (or the igniter) are (is) recrystallized, to thereby grow the crystal grain. In this case, the mean diameter of the crystal grain is preferably not less than 50 μm through the crystal grain growth. Even if the crystal is not grown progressively, the working (or machining, forming) conditions of the materials should be preferably so adjusted to obtain the mean diameter of the crystal grain of not less than 50 μm. If the heat treatment temperature is less than 800° C., the crystal grain of the metallic material does not have a satisfactory recrystallization or does not grow satisfactorily, thus making unobtainable the mean crystal grain diameter of not less than 50 μm. Contrary to this, if the heat treatment temperature is more than the melting point of the metallic material, the first and second chips 150 are so deformed as to become unusable. Therefore, the heat treatment temperature should be not less than 800° C. and less than the "melting point" of the metallic material, more preferably, not less than 900° C. and not more than a "solidus line temperature" of metallic material.

As is seen in FIG. 3(*a*), the plate material 300 is subjected to the heat treatment in a heat treatment furnace FK. As is seen in FIG. 3(*b*), the rod material 210 is subjected to the heat treatment in the heat treatment furnace FK. Moreover, as is seen in FIG. 3(*c*), the first and second chips 150 are subjected to the heat treatment in the heat treatment furnace FK.

Figure 4A:
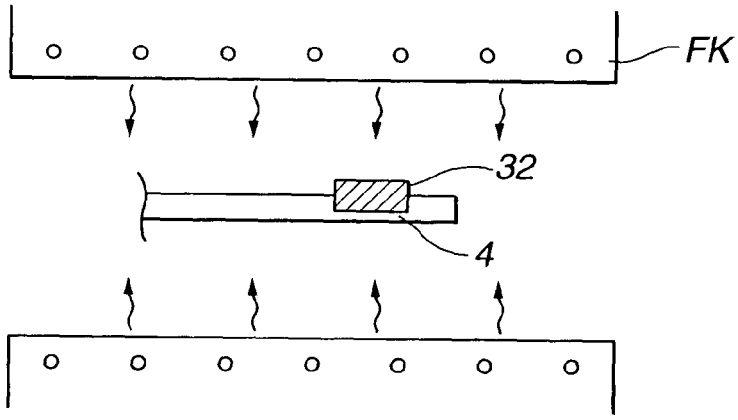
Figure 4B:
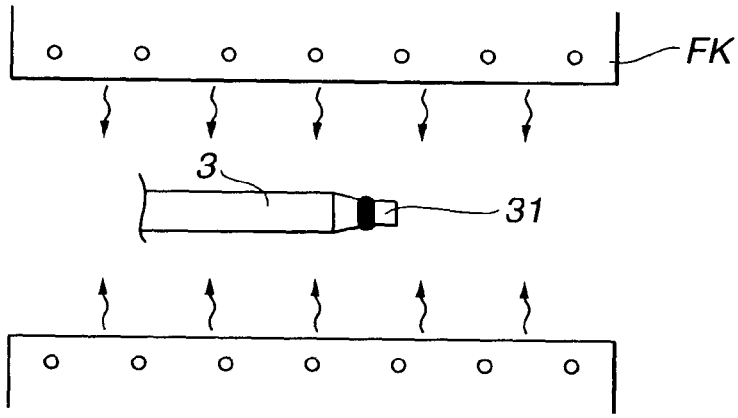

As is seen in FIG. 4(*a*), the second chip 32' can be welded, in advance, to the ground electrode 4 so as to form the second igniter 32, to thereby carry out the heat treatment of the second igniter 32 together with the ground electrode 4. Likewise, as is seen in FIG. 4(*b*), the first chip 31' can be welded, in advance, to the ground electrode 4 so as to form the first igniter 31, to thereby carry out the heat treatment of the first igniter 31 together with the center electrode 3.

The heat treatment can be carried out in one of a vacuum, a nitrogen atmosphere, a hydrogen atmosphere, and an inert gas atmosphere. Thereby, the oxidation-and-volatilization is effectively inhibited from occurring during the heat treatment, especially in the case of the metal alloy whose principal component is Ir.

The following experiments are carried out so as to validate the effect of the present invention:

EXAMPLE 1

Ni metal is blended and solved in Pt metal, to thereby prepare an alloy composed of Pt and 20% (mass) Ni. The alloy solution is obtained through a high frequency solution in an Ar (argon) atmosphere. Adjusting the oxygen content contained in the introduced Ar gas allows to prepare various alloy test samples such as those having oxygen content of 1 ppm, 43 ppm, 78 ppm, 113 ppm, and 140 ppm. The oxygen content contained in the alloy test sample is quantified in the following two steps: 1. The alloy test sample is heated and melted in an inert gas. 2. Then, the alloy test sample is analyzed by an NDIR (Non Dispersive Infrared Ray) absorption method. The alloy test sample is subjected to a cold rolling to be formed into a plate material having a thickness of 0.4 mm. The test sample that has the oxygen content of 140 ppm is subjected to the heat treatment at 900° C. in a vacuum atmosphere (degree of vacuum: $1.33\times10^{-3}$ Pa) for 500 minutes. Then, each plate material is subjected to an etching for a polished surface of the plate material. Then, an optical microscope is used for measuring a mean diameter of a crystal grain. The diameter of the individual crystal grain is measured in the following three steps: 1. Observe a visible outline of the crystal grain on the polished surface. 2. Draw a pair of outer tangent parallel lines each in a position as to form a maximum interval between the parallel lines. 3. Measure the maximum interval between the parallel lines. The thus measured interval between the parallel lines is regarded as the diameter of the individual crystal grain. As is seen in Table 1, there are listed the oxygen content (ppm), the mean crystal grain diameter (μm), the heat treatment conditions, and four test results.

Then, each of the plate materials is subjected to a cold punching (at an ordinary temperature). After the cold punching, there is obtained a chip which is shaped into a circular plate, 2.2 mm in diameter, 0.4 mm in thickness. As is seen in FIG. 2, the thus obtained chip is joined to one of the center electrode 3 and the ground electrode 4 by means of the resistance welding, to thereby form, respectively, one of the first igniter 31 and the second igniter 32. Thereby, there are prepared various kinds of spark plugs each having substantially the same configuration as that shown in FIG. 1(*a*) and FIG. 1(*b*). With the thus obtained spark plugs, the following four tests are to be carried out:

Test A: A test cycle having the following two steps are carried out: 1. Heat the igniter with a burner in the atmosphere for two minutes. 2. Then, cool the igniter in the atmosphere for one minute. Carry out the two steps of test by 1,000 cycles. After the 1,000 cycles of the test, visually check the condition of the igniter, according to the following acceptance criteria:

Acceptance criteria:

1. "Excellent" is awarded to test samples each causing no peel.
2. "Good" is awarded to test samples each having a slight peel on a surface of the igniter.
3. "Not acceptable" is awarded to test samples each having a peel up to inside the igniter.

Test B: The igniter is heated in a hydrogen gas current for eight hours in such a manner as to maintain the temperature around the igniter at 900° C. . Acceptance criteria are the same as those in Test A.

Test C: Test B is to be carried out. Then, Test A is to be carried out. Acceptance criteria are the same as those in Test A.

Test D: The following two test procedures are carried out: 1. The spark plug is mounted to a cogeneration gas engine. 2. The cogeneration gas engine is continuously operated at an output of 300 kW and at an engine speed of 1,500 rpm for 170 hours.

After the operation of the cogeneration gas engine, the condition of the igniter is visually checked, according to the following acceptance criteria:

Acceptance criteria:

1. "Excellent" is awarded to test samples each causing no sweat or peel.
2. "Good" is awarded to test samples each having a slight sweat or a slight peel, with the spark discharge gap after the test being narrower than an initial spark discharge gap by less than 0.05 mm.

3-I. "Not acceptable" is awarded to test samples each causing the bridging attributable to sweat or peel.

3-II. "Not acceptable" is also awarded to test samples each having the slight sweat or peel, with the spark discharge gap after the test being narrower than the initial spark discharge gap by 0.05 mm and over. In other words, test samples on the verge of causing the bridging.

Test results are shown in Table 1 below:

TABLE 1

| No. | Oxygen content (ppm) | Mean crystal grain diameter (μm) | Heat treatment conditions | Test result | | | |
|---|---|---|---|---|---|---|---|
| | | | | Test A | Test B | Test C | Test D |
| 1 | 1 | 15 | | Excellent | Excellent | Excellent | Excellent |
| 2 | 1 | 53 | 900° C., 500 min. | Excellent | Excellent | Excellent | Excellent |
| 3 | 43 | 15 | | Excellent | Excellent | Excellent | Excellent |
| 4 | 78 | 15 | | Excellent | Excellent | Good | Excellent |
| 5 | 113 | 15 | | Good | Good | Good | Good |
| 6 | 140 | 50 | 900° C., 500 min. | Good | Excellent | Good | Excellent |
| 7* | 140 | 15 | | Not acceptable | Not acceptable | Not acceptable | Not acceptable |
| 8 | 300 | 50 | 900° C., 500 min. | Good | Good | Good | Excellent |
| 9* | 340 | 50 | 900° C., 500 min. | Not acceptable | Not acceptable | Not acceptable | Not acceptable |

Remark:
*is not covered by the present invention.

As is seen in Table 1, when the oxygen content in the alloy is not more than 120 ppm, the sweat or peel is extremely unlikely to occur to the igniter. On top of that, even when the oxygen content in the alloy is more than 120 ppm, the sweat and peel of the igniter can be prevented from occurring by increasing the mean diameter of the crystal grain.

The entire contents of Japanese Patent Application No. P2000-199826 (filed Jun. 30, 2000) is incorporated herein by reference.

Although the invention has been described above by reference to certain embodiments of the invention, the invention is not limited to the embodiments described above. Modifications and variations of the embodiments described above will occur to those skilled in the art, in light of the above teachings. The scope of the invention is defined with reference to the following claims.

What is claimed is:

1. A spark plug comprising:

a center electrode;

a ground electrode opposing the center electrode in such a manner as to define a spark discharge gap between the center electrode and the ground electrode; and an igniter welded to one of the center electrode and the ground electrode in such a manner as to face the spark discharge gap, the igniter including an unfused igniter section composed of a metallic material whose principal component is one of a platinum and an iridium and a fused weldment section composed of the metallic material of the igniter section and a material of the one of the center electrode and the ground electrode, the metallic material of the igniter section including an oxygen content of not more than 120 ppm.

2. The spark plug as claimed in claim 1, wherein the metallic material which composes the igniter is an alloy containing a sub-component of a nickel.

3. The spark plug as claimed in claim 1, in which the metallic material composing the igniter is at least one of a platinum-nickel alloy, a platinum-iridium alloy, a platinum-iridium-nickel alloy, and an iridium-nickel alloy.

4. The spark plug as claimed in claim 3; in which the platinum-nickel alloy contains the nickel in a range from 2% to 40% of a total mass; in which the platinum-iridium alloy contains the iridium in a range from 2% to 98% of the total mass; in which the platinum-iridium-nickel alloy contains the iridium in a range from 2% to 40% of the total mass and contains the nickel in a range from 2% to 40% of the total mass, each of the iridium and the nickel of the platinum-iridium-nickel alloy being lower than the platinum in respect of a percentage content of the total mass; and in which the iridium-nickel alloy contains the nickel not less than 2% of the total mass.

5. The spark plug as claimed in claim 1, in which the spark discharge gap defined between the center electrode and the ground electrode is not more than 0.6 mm.

6. The spark plug as claimed in claim 5, in which the spark discharge gap defined between the center electrode and the ground electrode is in a range from 0.2 mm to 0.6 mm.

7. The spark plug as claimed in claim 1, in which the spark plug is mounted on an internal combustion engine which is a gas engine.

8. A spark plug comprising:

a center electrode;

a ground electrode opposing the center electrode in such a manner as to define a spark discharge gap between the center electrode and the ground electrode; and an igniter welded to one of the center electrode and the ground electrode in such a manner as to face the spark discharge gap, the igniter including an unfused igniter section composed of a metallic material whose principal component is one of a platinum and an iridium and a fused weldment section composed of the metallic material of the igniter section and a material of the one of the center electrode and the ground electrode, the metallic material of the igniter section comprising a crystal grain of more than 50 μm in a mean diameter, and including an oxygen content of not more than 300 ppm.

9. The spark plug as claimed in claim 8, in which the mean diameter of the crystal grain of the igniter is defined as a mean value of a maximum interval between a pair of parallel lines which are tangent to an outline of the crystal grain.

10. The spark plug as claimed in claim 8, wherein the metallic material which composes the igniter is an alloy containing a sub-component of a nickel.

11. The spark plug as claimed in claim 8, in which the metallic material composing the igniter is at least one of a platinum-nickel alloy, a platinum-iridium alloy, a platinum-iridium-nickel alloy, and an iridium-nickel alloy.

12. The spark plug as claimed in claim 11; in which the platinum-nickel alloy contains the nickel in a range from 2% to 40% of a total mass; in which the platinum-iridium alloy contains the iridium in a range from 2% to 98% of the total mass; in which the platinum-iridium-nickel alloy contains the iridium in a range from 2% to 40% of the total mass and contains the nickel in a range from 2% to 40% of the total mass, each of the iridium and the nickel of the platinum-iridium-nickel alloy being lower than the platinum in respect of a percentage content of the total mass; and in which the iridium-nickel alloy contains the nickel not less than 2% of the total mass.

13. The spark plug as claimed in claim 8, in which the spark discharge gap defined between the center electrode and the ground electrode is not more than 0.6 mm.

14. The spark plug as claimed in claim 13, in which the spark discharge gap defined between the center electrode and the ground electrode is in a range from 0.2 mm to 0.6 mm.

15. The spark plug as claimed in claim 8, in which the spark plug is mounted on an internal combustion engine which is a gas engine.

16. The spark plug as claimed in claim 8, in which the metallic material of the igniter comprises a crystal grain of not less than 53 μm in a mean diameter.

17. A method of producing a spark plug, said spark plug comprising:

a center electrode;

a ground electrode opposing the center electrode in such a manner as to define a spark discharge gap between the center electrode and the ground electrode; and an igniter welded to one of the center electrode and the ground electrode in such a manner as to face the spark discharge gap, the igniter including an unfused igniter section composed of a metallic material whose principal component is one of a platinum and an iridium and a fused weldment section composed of the metallic material of the igniter section and a material of the one of the center electrode and the ground electrode, the metallic material of the igniter section comprising a crystal grain of more than 50 μm in a mean diameter, and including an oxygen content of not more than 300 ppm, the method comprising the following sequential steps of:

carrying out a heat treatment on a metallic material chip at a heat treatment temperature of not less than 800° C. and not more than a melting point of the metallic material chip, so that a crystal grain of the metallic material chip is more than 50 μm in a mean diameter with the metallic material chip comprising an oxygen content of not more than 300 ppm, the metallic material chip comprising a principal component of one of a platinum and an iridium;

welding the metallic material chip to at least one of a center electrode and a ground electrode; and forming an igniter based on the metallic material chip.

18. The method as claimed in claim 17; in which the heat treatment of the metallic material chip is carried out in one of a reduced pressure atmosphere and a hydrogen atmosphere, so that the metallic chip is recrystallized to grow the crystal grain to more than 50 μm in the mean diameter, the mean diameter of the crystal grain of the metallic material chip being defined as a mean value of a maximum interval between a pair of parallel lines which are tangent to an outline of the crystal grain; and in which the metallic material chip comprising the platinum is subjected to a resistance welding while the metallic chip comprising the iridium is subjected to a laser welding.

19. A method of producing a spark plug, said spark plug comprising a center electrode;

a ground electrode opposing the center electrode in such a manner as to define a spark discharge gap between the center electrode and the ground electrode; and an igniter welded to one of the center electrode and the ground electrode in such a manner as to face the spark discharge gap, the igniter including an unfused igniter section composed of a metallic material whose principal component is one of a platinum and an iridium and a fused weldment section composed of the metallic material of the igniter section and a material of the one of the center electrode and the ground electrode, the metallic material of the igniter section comprising a crystal grain of more than 50 μm in a mean diameter, and including an oxygen content of not more than 300 ppm, the method comprising the following sequential steps of:

welding a metallic material chip to at least one of a center electrode and a ground electrode, the metallic material chip comprising a principal component of one of a platinum and an iridium;

carrying out a heat treatment on the metallic material chip welded to the at least one of the center electrode and the ground electrode at a heat treatment temperature of not less than 800° C. and not more than a melting point of the metallic material chip, so that a crystal grain of the metallic material chip is more than 50 μm in a mean diameter with the metallic material chip comprising an oxygen content of not more than 300 ppm; and forming an igniter based on the metallic material chip.

20. The method as claimed in claim 19; in which the heat treatment of the metallic material chip is carried out in one of a reduced pressure atmosphere and a hydrogen atmosphere, so that the metallic material chip is recrystallized to grow the crystal grain to more than 50 μm in the mean diameter, the mean diameter of the crystal grain of the metallic material chip being defined as a mean value of a maximum interval between a pair of parallel lines which are tangent to an outline of the crystal grain; and in which the metallic material chip comprising the platinum is subjected to a resistance welding while the metallic chip comprising the iridium is subjected to a laser welding.

21. A spark plug comprising:

a center electrode;

a ground electrode opposing the center electrode in such a manner as to define a spark discharge gap between the center electrode and the ground electrode; and an igniter welded welded to one of the center electrode and the ground electrode in such a manner as to face the spark discharge gap, the igniter including an igniter section composed of a metallic material whose principle component is one of platinum and an iridium and a weldment section composed of the metallic material of the igniter section and a material of the one of the center electrode and the ground electrode, the metallic material of the igniter section including an oxygen content of not more than 120 ppm, wherein the igniter section is not influenced by a composition change, through welding.

22. A spark plug comprising:

a center electrode;

a ground electrode opposing the center electrode in such a manner as to define a spark discharge gap between the center electrode and the ground electrode; and an igniter welded to one of the center electrode and the ground electrode in such a manner as to face the spark discharge gap, the igniter including an igniter section composed of a metallic material whose principle component is one of platinum and an iridium and a weldment section composed of the metallic material of the igniter section and a material of the one of the center electrode and the ground electrode, the metallic material of the igniter section comprising a crystal gain of more than 50 μm in a mean diameter, and including an oxygen content of not more than 300 ppm, wherein the igniter section is not influenced by a composition change, through welding.

* * * * *